United States Patent [19]

Kuo-Liang

[11] Patent Number: 5,048,821

[45] Date of Patent: Sep. 17, 1991

[54] STEPPING EXERCISER STEP PLATES LINK MOTION MECHANISM

[76] Inventor: Wang Kuo-Liang, No. 1, Lane 154, Chang-Lung Rd., Tou-Pien Keng, Tai-Ping Hsiang, Taichung Hsien, Taiwan

[21] Appl. No.: 617,149

[22] Filed: Nov. 23, 1990

[51] Int. Cl.[5] ..... A63B 23/04

[52] U.S. Cl. ..... 272/70; 272/130

[58] Field of Search ..... 272/69, 70, 130, 73, 272/72, 129, 71, 96, 97; 128/25 R

[56] References Cited

U.S. PATENT DOCUMENTS

| | | | |
|---|---|---|---|
| 4,708,338 | 11/1987 | Potts | 272/70 |
| 4,720,093 | 1/1988 | Delmar | 272/70 |
| 4,934,690 | 6/1990 | Bull | 272/70 |

*Primary Examiner*—Stephen R. Crow
*Attorney, Agent, or Firm*—Bacon & Thomas

[57] ABSTRACT

A stepping exerciser step plates link motion mechanism for forcing the two step plates of a stepping exerciser to smoothly efficiently oscillate back and forth at two opposite sides of a base plate during stepping exercises, comprising a lever pivotably secured to a mounting plate at the bottom of the base plate; two holder plates fixedly secured to the two step plates; a first pair of axles respectively rotatably fastened in the two holder plates; a second pair of axles respectively rotatably fastened in the two opposite ends of the lever and disposed in parallel with the first pair of axles, two flat rocker arms pivotably connected between the first and second pair of axles to link up the lever with the two step plates.

2 Claims, 6 Drawing Sheets

STEPPING EXERCISER STEP PLATES LINK MOTION MECHANISM

BACKGROUND OF THE INVENTION

1. Field of the Invention

The present invention relates to stepping exercisers, and more particularly to a stepping exerciser which comprises a step plates link motion mechanism to effectively accurately force the two step plates to alternatively oscillate back and forth without causing mechanical sticking problem.

2. Description of the Prior Art

In the conventional structure of stepping exerciser, the two step plates for stepping are connected to alternatively oscillate up and down by a rope which is mounted on a rope pulley fastened in the machine frame at the top. Because the rope has a fixed length with its two opposite ends respectively secured to the two step plates of the stepping exerciser, when a first step plate is stepped downward, the other step plate is simultaneously pulled by the rope to lift. This structure is not practical in use, because of the following disadvantages:

1. Because the rope to link the two step plates has somewhat a resilient property which causes the step plates to vibrate when they are alternatively moved to the upper or lower limit. Because of the vibration problem of the step plates during operation, step instability may occur.

2. Because the two step plates are linked by the rope to alternatively oscillate up and down, they tend to simultaneously move up or down during operation, or the rope may disengage from the rope pulley easily to obstruct the operation.

In U.S. Pat. No. 4,934,690 there is disclosed an exercising machine for use in the standing position, which has means to effectively eliminate shock waves from the two levers (step plates) during stepping exercises. In this structure of exercising machine, a rod is fastened at the bottom of the machine frame and respectively connected to the two levers by two rocker arms. During operation, as shown in FIG. 1, the two opposite ends of the rod 1 are alternatively oscillated up and down. However, because the lower joint 21 of each rocker arm 2 is carried by the rod 1 to move left and right while the upper joint 22 is confined to oscillate back and forth, the rocker arms 2 may be distorted during operation of the machine. Referring to FIG. 2, when the levers 3 are alternatively stepped to move up and down through a circular track, the upper joint 22 of each rocker arm 2 is simultaneously carried to oscillate back and forth. However, because the lower joint 21 of each rocker arm 2 is confined to oscillate left and right, the rocker arms 2 may be distorted easily.

SUMMARY OF THE INVENTION

The present invention has been accomplished to eliminate the aforesaid problems. It is therefore an object of the present invention to provide a step plates link motion mechanism for a stepping exerciser, which can force the two step plates of a stepping exerciser to smoothly oscillate back and forth.

It is another object of the present invention to provide a step plates link motion mechanism for a stepping exerciser, which can eliminate vibration from a stepping exerciser during stepping exercises.

It is still another object of the present invention to provide a step plates link motion mechanism for a stepping exerciser, which is permitted to oscillate up-and-down and back-and-forth, so as to protect the connected mechanical parts from becoming stuck.

Figure 1:
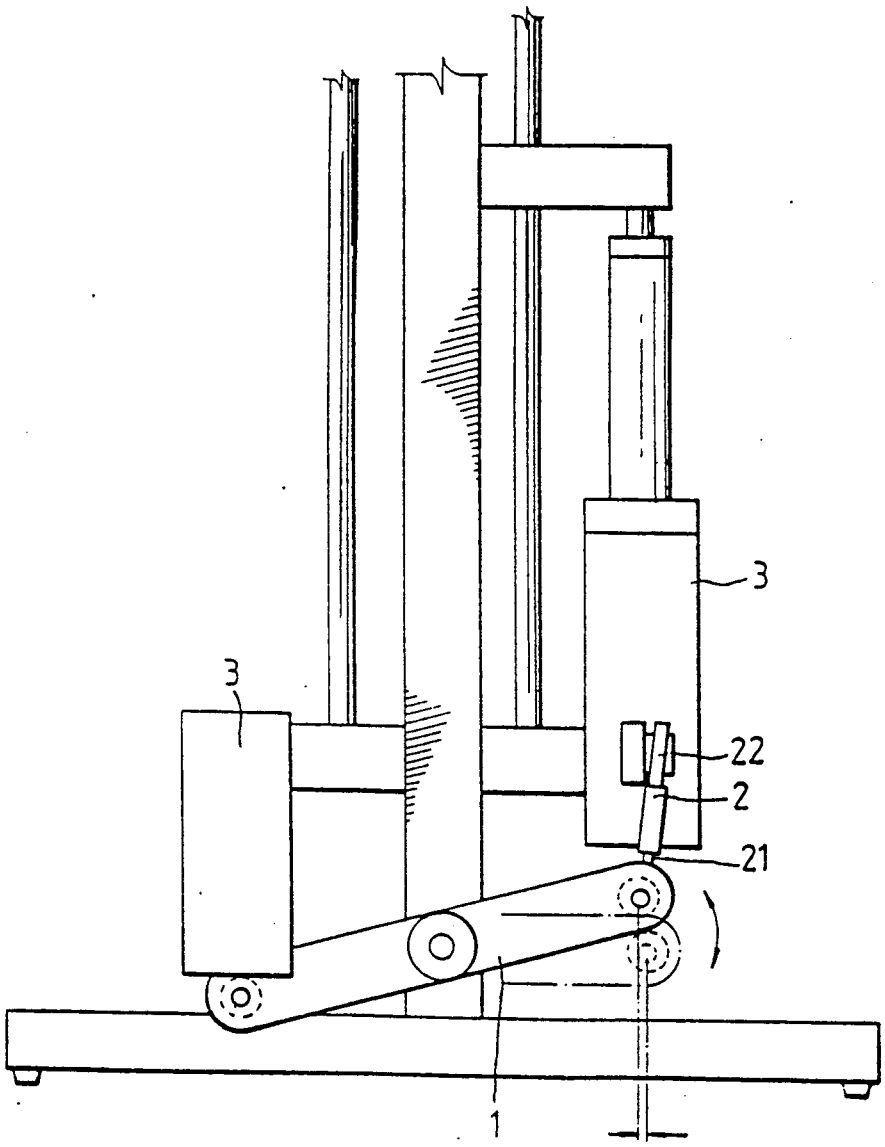
FIG. 1 (PRIOR ART)
FIG. 1 is a schematic front view of a stepping exerciser according to the prior art.
Figure 2:
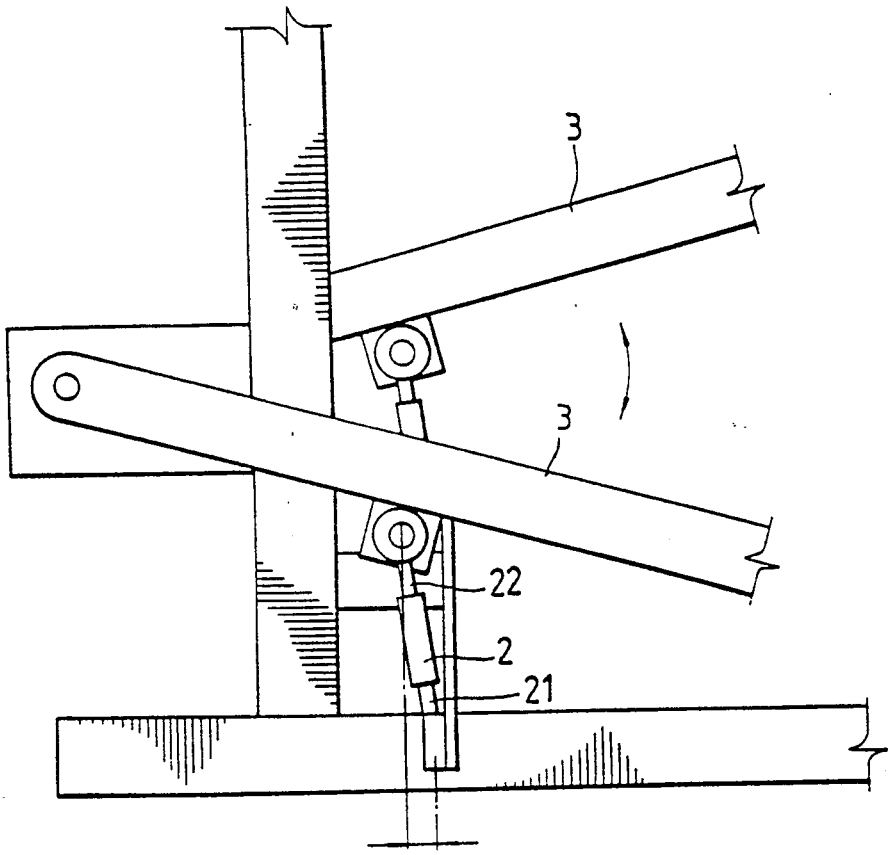
FIG. 2 (PRIOR ART)
FIG. 2 is a schematic side view of said stepping exerciser according to the prior art.
Figure 3:
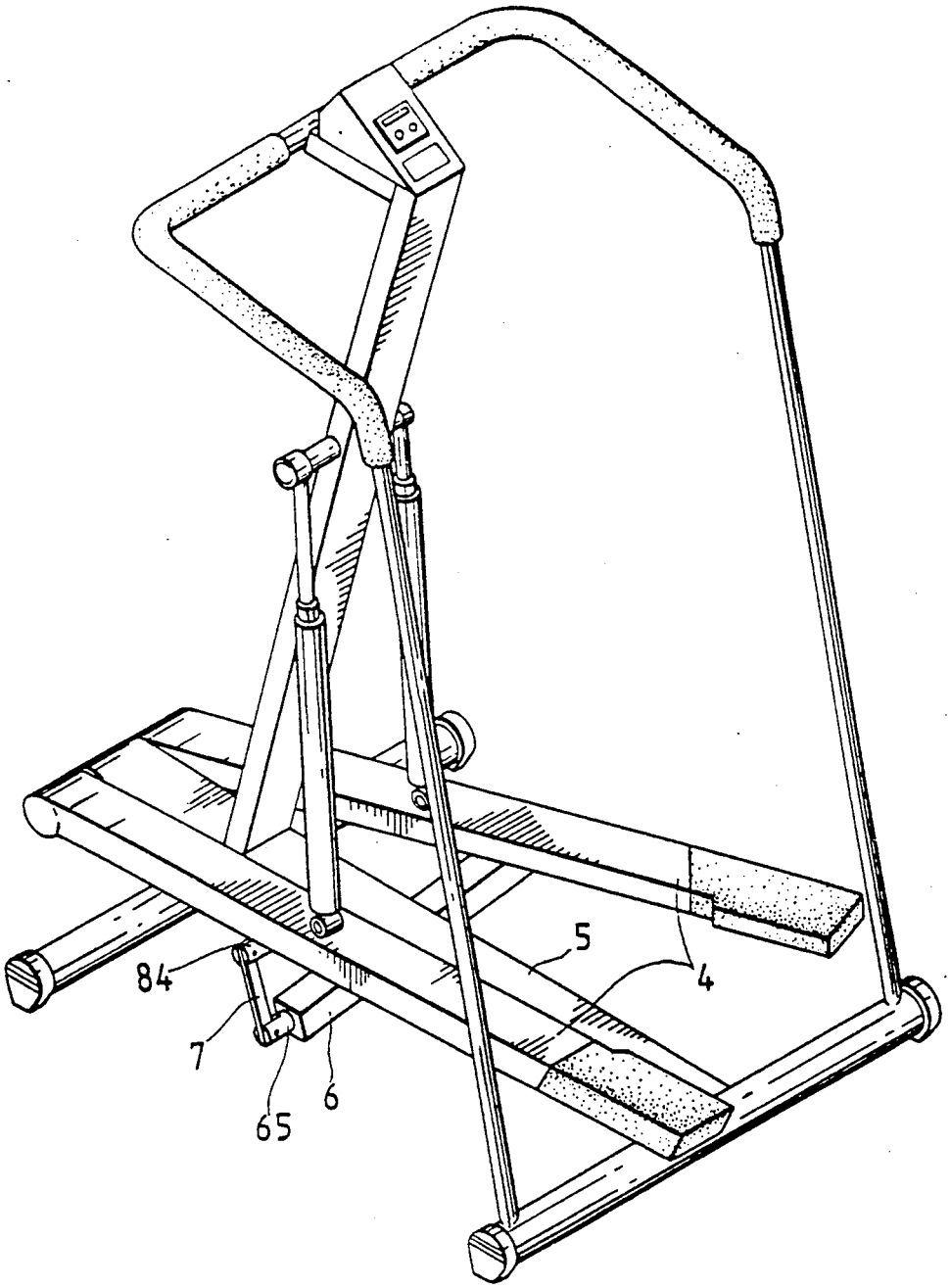
FIG. 3 illustrates a stepping exerciser embodying the present invention.
Figure 4:
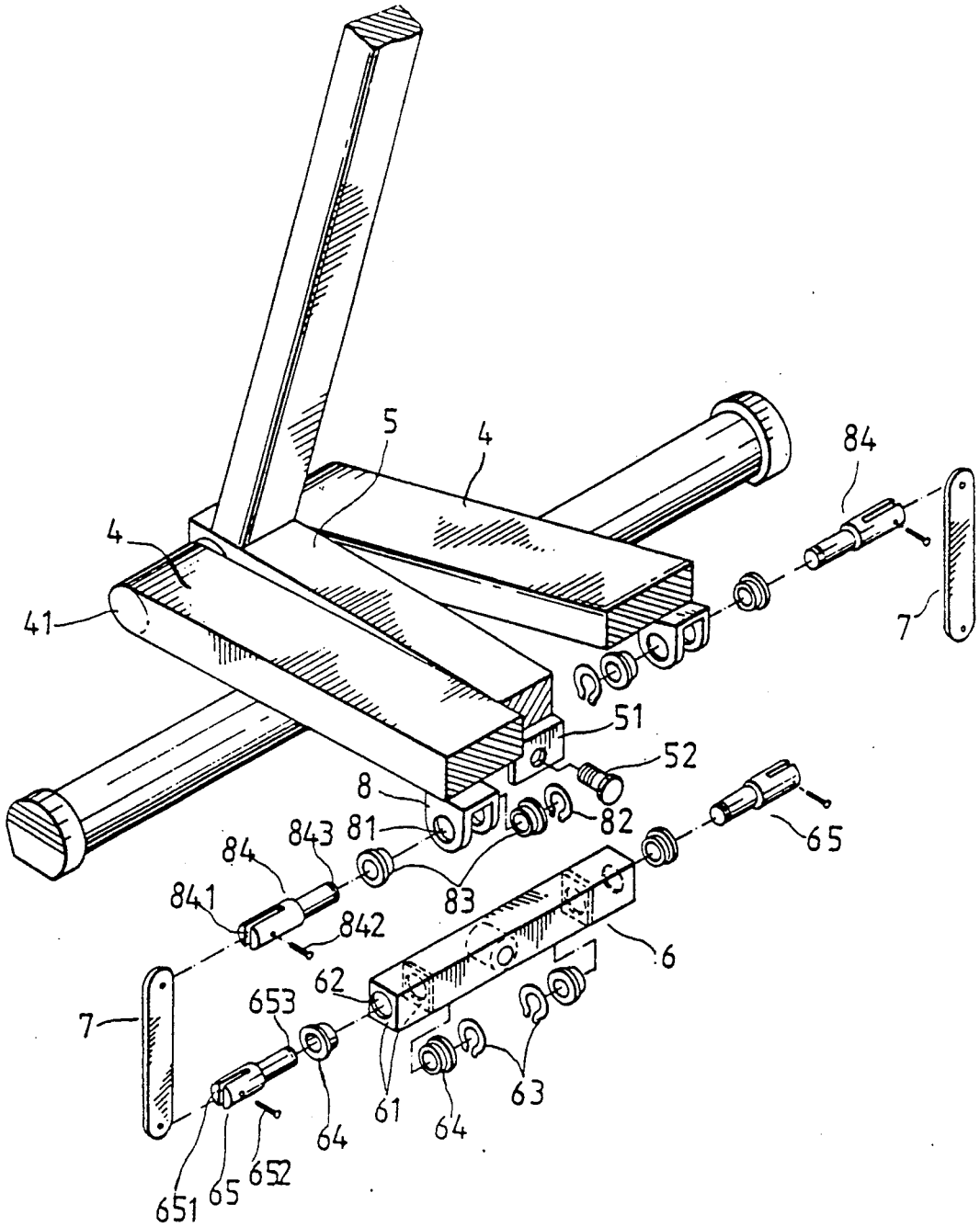
FIG. 4 is a perspective dismantled view of the present invention.

DETAILED DESCRIPTION OF THE PREFERRED EMBODIMENT:

Referring to FIGS. 3 and 4, in a stepping exerciser there is a base plate 5 disposed between two step plates 4. A mounting plate 51 is secured to the base plate 5 at the bottom for pivotably securing thereto of a lever 6 by a pivot 52, which lever 6 is designed in such a size that the two opposite ends thereof are respectively disposed beneath the two step plates 4. Because the lever 6 is attached to the mounting plate 51 by the pivot 52, it is permitted to alternatively oscillate up and down. The lever 6 comprises two axle seats 61 at two opposite ends of which each defines therein a through-hole 62 axially disposed at the center for mounting an axle 65 each. Two axle bushes 64 are respectively on each axle 65 inside the through-hole 62 of each axle seat 61, so that the axles 65 are permitted to respectively rotate on the two axle seats 61. Two U-shaped holder plates 8 are respectively fastened in the two step plates 4 at the bottom and disposed right above the two axles 65. The two U-shaped holder plates 8 have each a through-hole 81 through the two opposite side walls thereof for mounting an axle 84 which is inserted through two axle bushes 83 inside the through-hole 81 of each U-shaped holder plate 8. Therefore, these two axles 84 are also permitted to respectively rotate on the two U-shaped holder plates 8. The two axles 65 of the lever 6 and the two axles 84 of the two holder plates 8 have each a notch 651 or 841 for mounting a flat rocker arm 7 through a pivot bolt 652 or 842, i.e. two opposite, flat rocker arms 7 are respectively connected between the axles 84 of the U-shaped holder plates 8 and the axles 65 of the lever 6 at two opposite sides. Therefore, the axles 65 and 84 are connected by the two rocker arms 7 for link motion. The opposite end of each axle 65 or 84 which is inserted through axle bushes 64 or 83 and fastened in the through-hole 62 of the corresponding axle seat 61 of the lever 6 or the through-hole 81 of the corresponding U-shaped holder plate 8 has an annular groove 653 or 843 made thereon and retained inside the corresponding axle seat 61 or U-shaped holder plate 8 by a C-shaped retainer ring 63 or 82.

Figure 5:
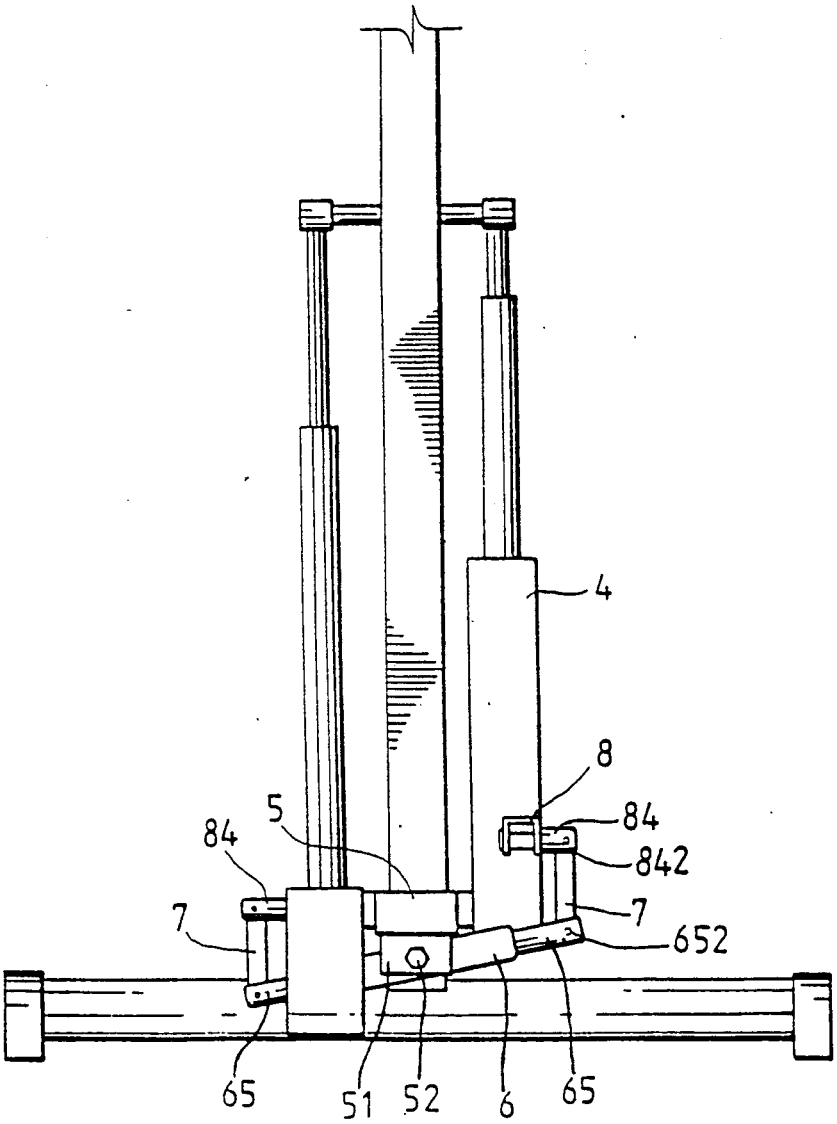
FIG. 5 is a front view of the preferred embodiment of the present invention.

Referring to FIG. 5, when one of the two step plates 4 is stepped down during exercise, one end of the lever 6 is forced by the directly connected axles 84 and 65 and rocker arm 7 to oscillate downward, and the other end of the lever 6 is forced to oscillate upward. Because the two step plates 4 are respectively connected to the lever 6 through the axles 84 and 65 and the rocker arms 7 for link motion, the two step plates 4 are forced to alternatively oscillate up and down during stepping exercises.

In order to ensure smooth, accurate, alternative oscillation of the two step plates 4, the link motion mechanism of the present invention is most preferably made of steel material of low coefficient of resilience. Because the two opposite ends of the lever 6 are moved to oscillate back and forth through a circular track relative to the pivot 52 (see FIG. 5), certain measure must be taken to protect the connected parts from sticking. This problem is eliminated by connecting the rocker arms 7 to the axles 84 and 65 through pivot bolts 652 and 842, permitting the rocker arms 7 to follow the lever 6 to oscillate.

Figure 6:
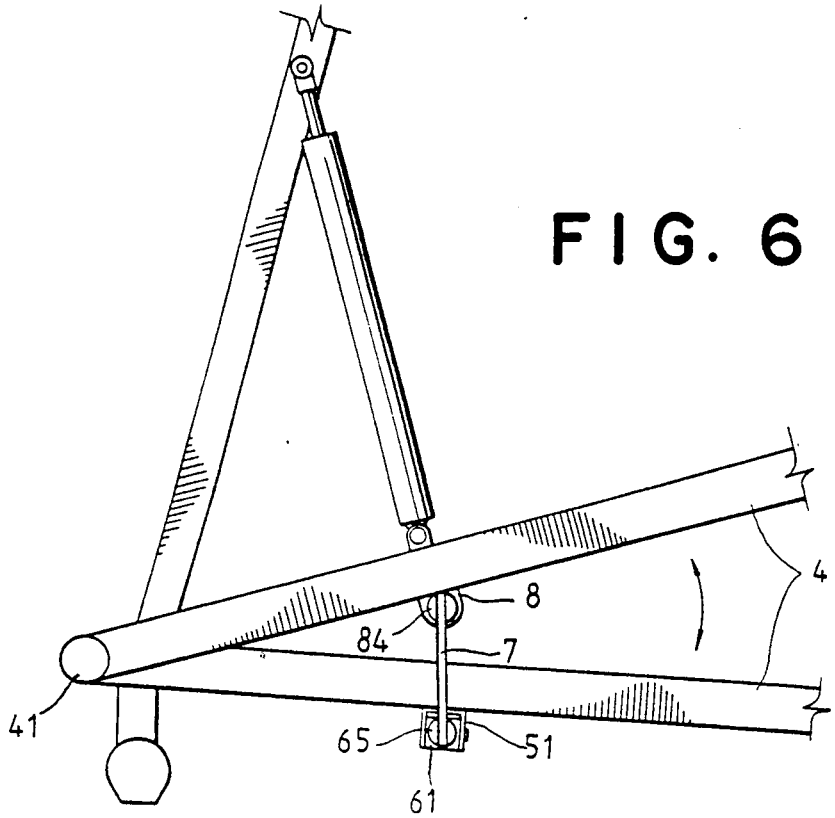
FIGS. 6 and 7 are schematic side views, illustrating the operation of the present invention.
Figure 7:
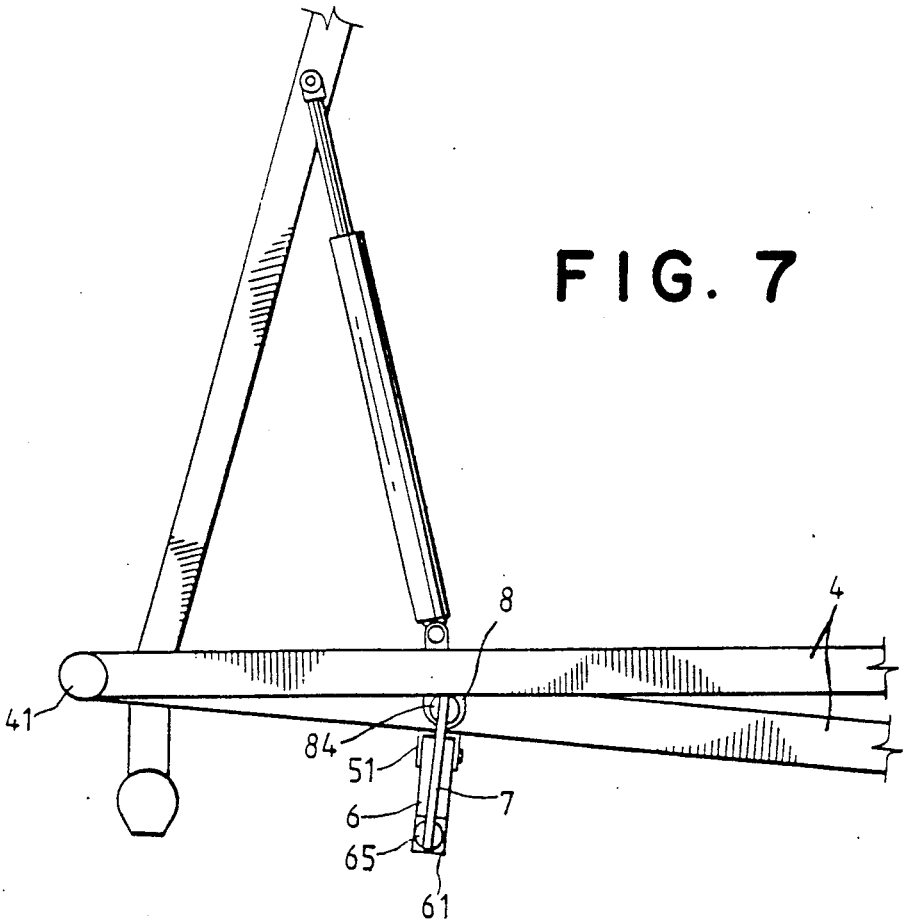

Referring to FIGS. 6 and 7, the two step plates 4 are respectively mounted to oscillate on a common pivot axis 41, therefore, the two U-shaped holder plates 8 are carried by the step plates 4 to alternatively oscillate back and forth through the same circular track (as the arrow indicated). Because the two opposite ends of the lever 6 can only be rotated up and down, certain measure must be taken so that the up-and-down motion of the lever 6 can fit in with the back-and-forth oscillation of the step plates 4. In the present invention, the axles 65 and 84 are designed to respectively rotate on the axle seats 61 of the lever or the U-shaped holders 8, so that the rocker arms 7 are permitted to rotate back and forth while the step plates 4 are moved to oscillate up and down. Therefore, the parts of the step plates link motion mechanism do not get stuck.

Thus, it is apparent that there has been provided, in accordance with the invention, a stepping exerciser step plates link motion mechanism to effectively force the two step plates of a step exerciser to alternatively oscillate back and forth.

I claim:

1. For accurately forcing the two step plates of a stepping exerciser to smoothly alternatively oscillate back and forth at the two opposite sides of a base plate during stepping exercises, a step plates link motion mechanism comprising:

a mounting plate secured to said base plate of said stepping exerciser at the bottom of said base plate;

a lever pivotably secured to said mounting plate by a pivot bolt, having two axle seats at two opposite ends and respectively disposed beneath said two step plates, said axle seats having each a through-hole through the central axis of said lever;

a pair of holder plates respectively secured to said two step plates at the bottom of each respective step plate, and disposed above said lever, said pair of holder plates having each a through-hole disposed in parallel with the through-hole of said axle seats;

a first pair of axles respectively rotatably fastened in the through-hole of said pair of holder plates, each having a notched end respectively disposed outside said pair of holder plates;

a second pair of axles respectively rotatably fastened in the through-hole of said two axle seats; and a pair of flat rocker arms each having one end pivotably fastened in the notched end of said first pair of axles by a pivot pin and an opposite end pivotably fastened in the notched end of said second pair of axles.

2. The step plates link motion mechanism of claim 1, wherein said first and second pair of axles each having a mounting end inserted through two opposite axle bushes inside the through-hole of either one of said pair of holder plates or the through-hole of either one of said two axle seats, and respectively firmly retained by a C-shaped retainer ring each which is mounted on an annular groove made on said mounting end.

* * * * *